US007841894B2

(12) United States Patent
Gong et al.

(10) Patent No.: US 7,841,894 B2
(45) **Date of Patent: *Nov. 30, 2010**

(54) STACKED ELECTRONICAL CONNECTOR

(75) Inventors: Hong-Bin Gong, Kunshan (CN); Zhong-Hua Yao, Kunshan (CN); Qi-Sheng Zheng, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

This patent is subject to a terminal disclaimer.

(21) Appl. No.: 12/387,081

(22) Filed: Apr. 28, 2009

(65) Prior Publication Data

US 2009/0269980 A1 Oct. 29, 2009

(30) Foreign Application Priority Data

Apr. 28, 2008 (CN) ..... 2008 2 0300645 U
Apr. 30, 2008 (CN) ..... 2008 2 0035891 U

(51) Int. Cl.
*H01R 13/60* (2006.01)

(52) U.S. Cl. ..... 439/541.5; 439/540.1; 439/79

(58) Field of Classification Search ..... 439/541.5, 439/607, 35, 607.38, 607.49, 607.4, 607.55, 439/500, 79, 540.1
See application file for complete search history.

(56) References Cited

U.S. PATENT DOCUMENTS 5,755,595 A * 5/1998 Davis et al. ..... 1/1
6,027,375 A * 2/2000 Wu ..... 439/607.02
6,083,044 A * 7/2000 Wang et al. ..... 439/567
6,095,861 A * 8/2000 Lin et al. ..... 439/607.25
6,347,961 B2 * 2/2002 Zhu et al. ..... 439/607.01
6,368,151 B1 * 4/2002 Chen et al. ..... 439/541.5
6,394,846 B1 * 5/2002 Belopolsky et al. .... 439/620.11
D482,659 S * 11/2003 Zhang ..... D13/147
7,044,790 B2 * 5/2006 Zhu et al. ..... 439/607.27
2004/0229502 A1 * 11/2004 Hu et al. ..... 439/541.5
2007/0232132 A1 * 10/2007 Ling et al. ..... 439/541.5
2007/0293083 A1 * 12/2007 Wang et al. ..... 439/541.5
2009/0305555 A1 * 12/2009 Wang et al. ..... 439/541.5

* cited by examiner

*Primary Examiner*—T C Patel
*Assistant Examiner*—Harshad C Patel
(74) *Attorney, Agent, or Firm*—Wei Te Chung; Andrew C. Cheng; Ming Chieh Chang

(57) ABSTRACT

A stacked electrical connector (1) includes an insulative housing (2) and a number of contacts (3) retained in the insulative housing (2). The insulative housing (2) includes a first housing (21) and a second housing (22) arranged in an up-to-down direction. The first housing (21) defining a number of inserting ports (213) recessed from a front end thereof. The second housing (22) defines a receiving space (224) to receive a standard USB 2.0 B type plug. The contacts (3) include a number of first contacts (31) retained in the first housing (21) and a number of second contacts (32) retained in the second housing (22). Each first contact (31) has a first contact portion (311) extending into the inserting port (213). Each second contact (32) has a second contact portion (321) and a second soldering portion (324) being arranged in a row in a level direction.

17 Claims, 8 Drawing Sheets

STACKED ELECTRONICAL CONNECTOR

BACKGROUND OF THE INVENTION

1. Field of the Invention

The present invention relates to an electrical connector, and more particularly to a stacked electrical connector.

2. Description of Related Art

With rapid development of the electronic industry, increasing electrical connectors are employed with peripherals, such as computers, printers, PDA, etc, to transmit various signals with each other. Such a peripheral usually has a circuit board, and the electrical connectors are usually singly soldered on the circuit board. When the number of the electrical connectors are increased, the circuit board would not have enough space to hold the electrical connectors thereon. Thereby, the circuit board needs to be enlarged for having a larger space, and the cubage of the peripherals will be enlarged at the same time. However, the larger peripherals are not loved by consumers and are not adapt to a miniature development of the electronic industry.

Hence, an electrical connector is desired to overcome the disadvantage of the prior art.

BRIEF SUMMARY OF THE INVENTION

According to one aspect of the present invention, A stacked electrical connector comprises an insulative housing comprising a first housing and a second housing arranged in an up-to-down direction, the first housing defining a plurality of inserting ports recessed from a front end thereof, all the inserting ports being arranged in a row in a level direction perpendicular to the upper to down direction, the second housing defining a receiving space to receive a standard USB 2.0 B type plug and a tongue received in the receiving space; and a plurality of contacts comprising a plurality of first contacts retained in the first housing and a plurality of second contacts retained in the second housing, each first contact having a first contact portion extending into the inserting port and a first soldering portion extending downwardly, each second contact having a second securing portion retained in the second housing, a second contact portion extending to an upper or lower side of the tongue from the second securing portion and a second soldering portion extending downwardly from the second securing portion, the second soldering portions of all the second contacts being arranged in a row in the level direction.

According to another aspect of the present invention, A stacked electrical connector comprises an insulative housing comprising a first housing and a second housing arranged in an up-to-down direction, the first housing defining a plurality of inserting ports recessed from a front end thereof, the second housing having a front face and a rear face opposite to the front face; and a plurality of contacts comprising a plurality of first contacts retained in the first housing, each first contact having a first securing portion retained in the first housing, a first contact portion extending into the inserting port from the first securing portion, a first soldering portion extending out of the insulative housing and a first connecting portion between the first securing portion and the first soldering portion; wherein the second housing has a plurality of projections extending backwardly from the rear face, and each projection defines a recessed portion to retain the first connecting portion.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENT

Figure 1:
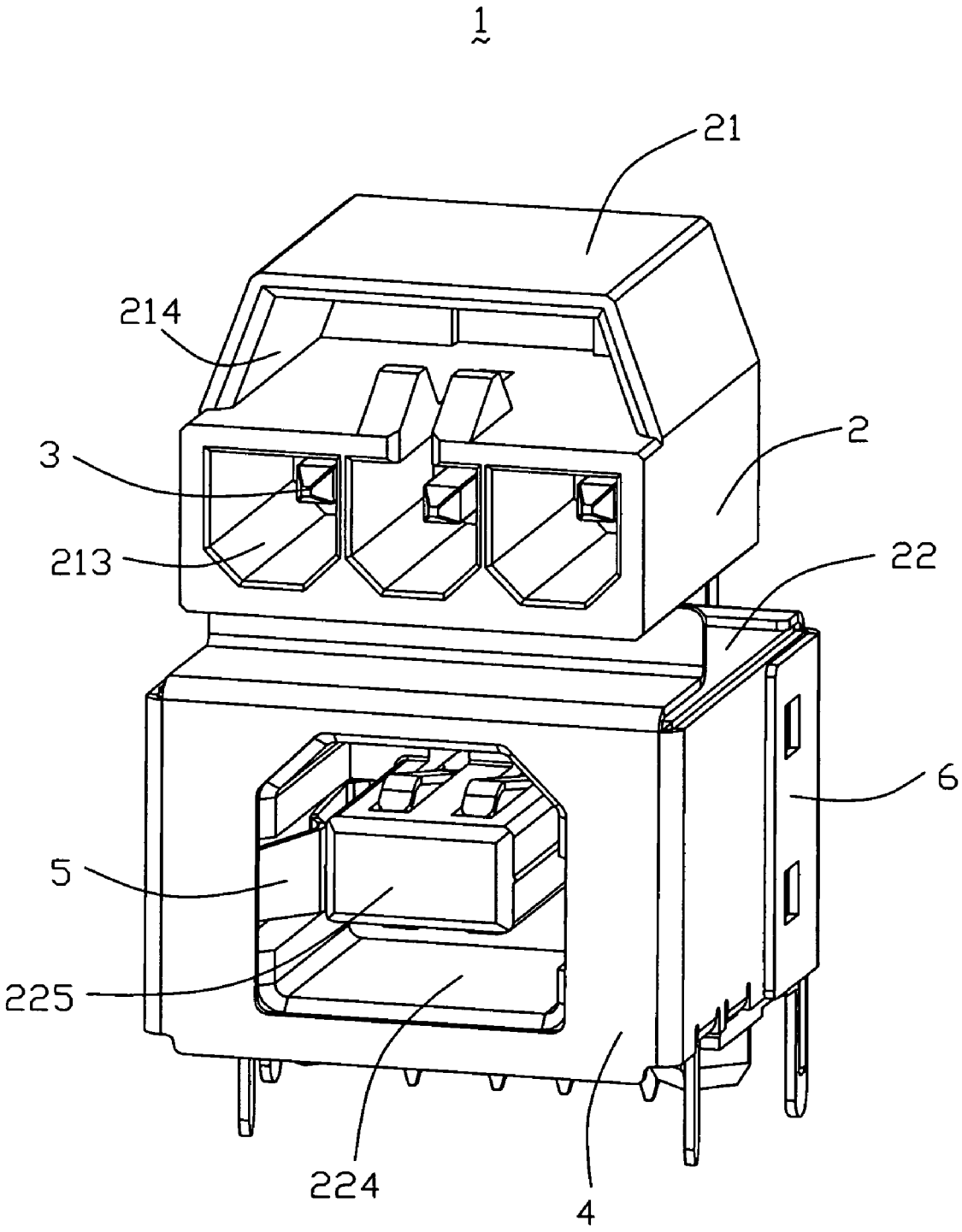
FIG. 1 is a perspective view of a stacked electrical connector according to one embodiment of the present invention.

In the following description, numerous specific details are set forth to provide a thorough understanding of the present invention. However, it will be obvious to those skilled in the art that the present invention may be practiced without such specific details. In other instances, well-known circuits have been shown in block diagram form in order not to obscure the present invention in unnecessary detail. For the most part, details concerning timing considerations and the like have been omitted inasmuch as such details are not necessary to obtain a complete understanding of the present invention and are within the skills of persons of ordinary skill in the relevant art.

Referring to FIGS. 1-6, a stacked electrical connector 1 according to one embodiment of the present invention is disclosed. The stacked electrical connector 1 comprises an insulative housing 2, a plurality of contacts 3 retained in the insulative housing 2, a metal shell 4 covering the insulative housing 2, a pair of spring arms 5 retained in the insulative housing 2, and a rear shell 6 located between the contacts 3.

Figure 4:
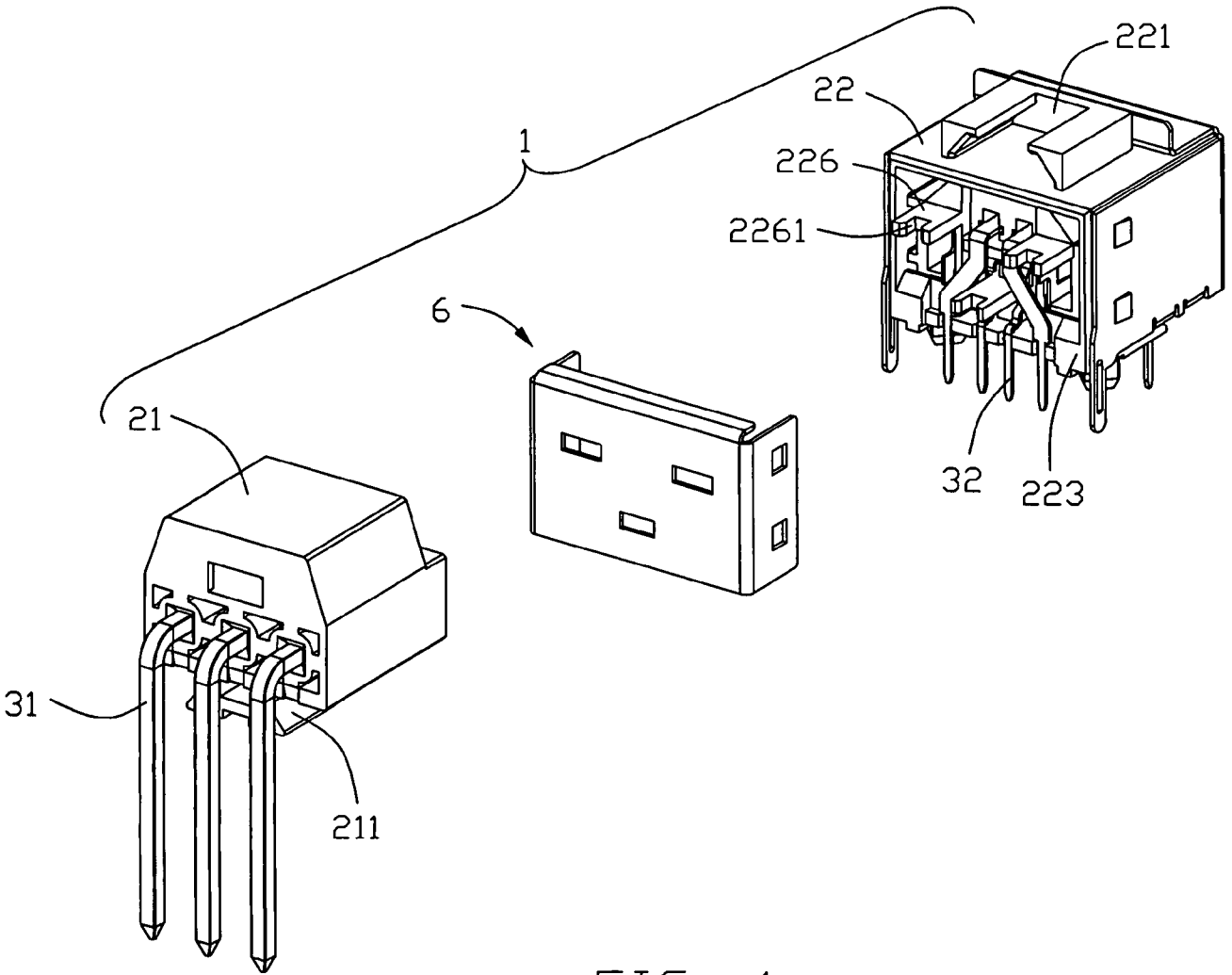
FIG. 4 is a partial exploded view of the stacked electrical connector shown in FIG. 1.

Referring to FIG. 4, the insulative housing 2 comprises a first housing 21 and a second housing 22 stacked with each other along an up-to-down direction. The first housing 21 is narrower than the second housing 22 along a level direction perpendicular to the up-to-down direction. The first housing 21 has a swallow-tailed block 211 at bottom thereof. The second housing 22 defines a swallow-tailed recess 221 to engage with the swallow-tailed block 211 for fixing the first housing 21 and the second housing 22 together. Of course, the first housing 21 and the second housing 22 can be integrally stamped in an insulator in the other embodiment.

Figure 2:
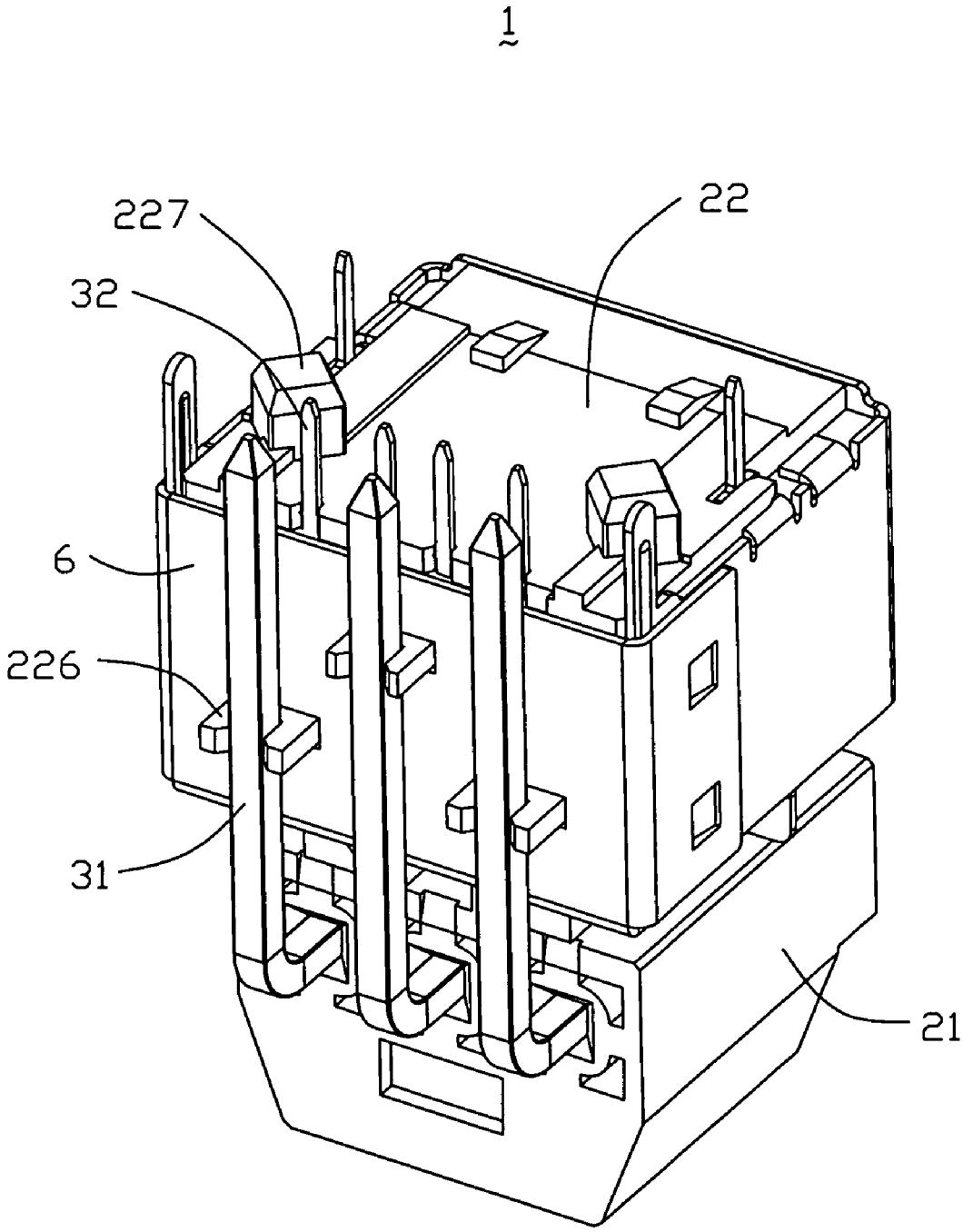
FIG. 2 is a view similar to FIG. 1, while taken from another aspect.
Figure 3:
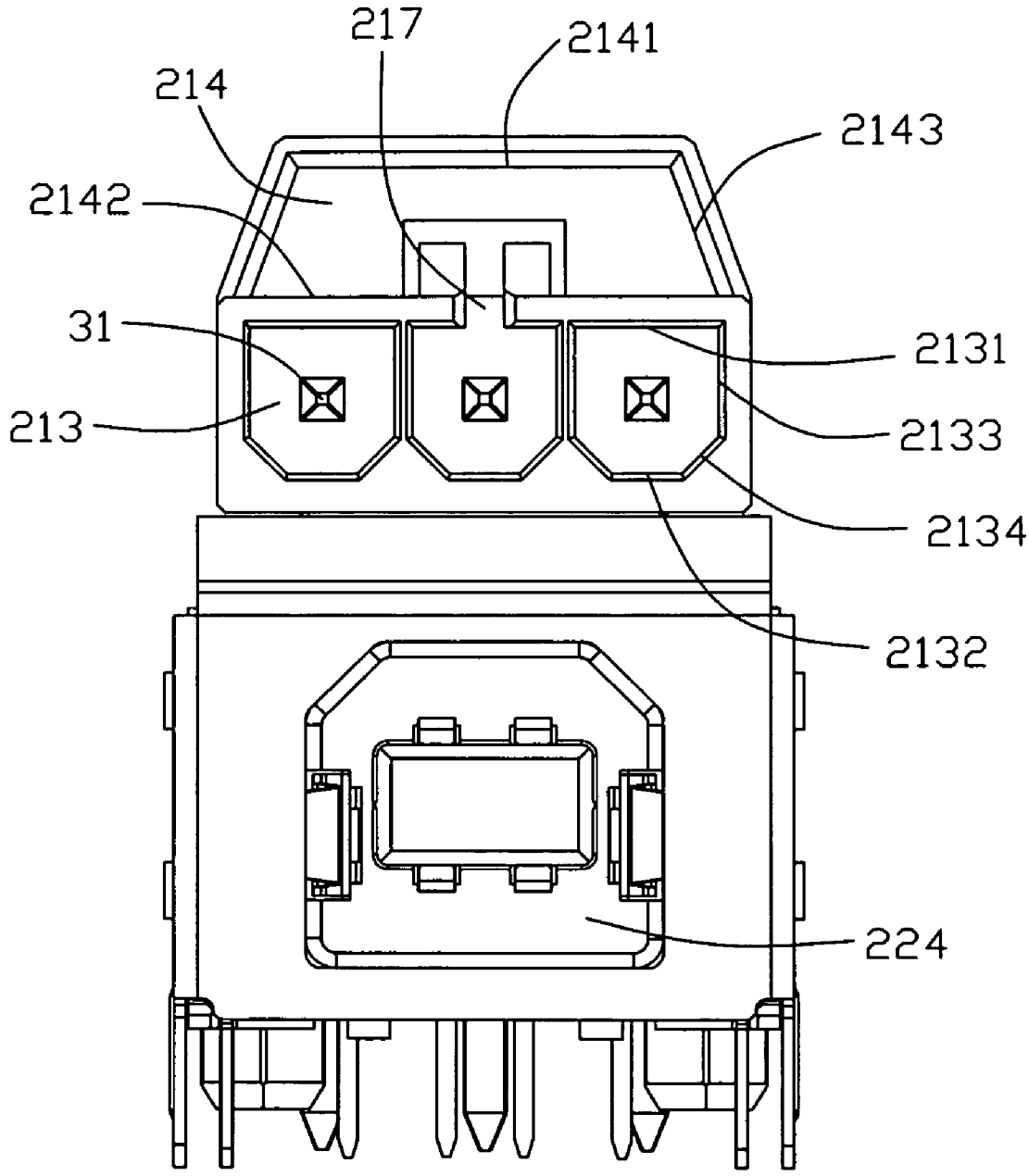
FIG. 3 is a front elevational view of the stacked electrical connector shown in FIG. 1.
Figure 5:
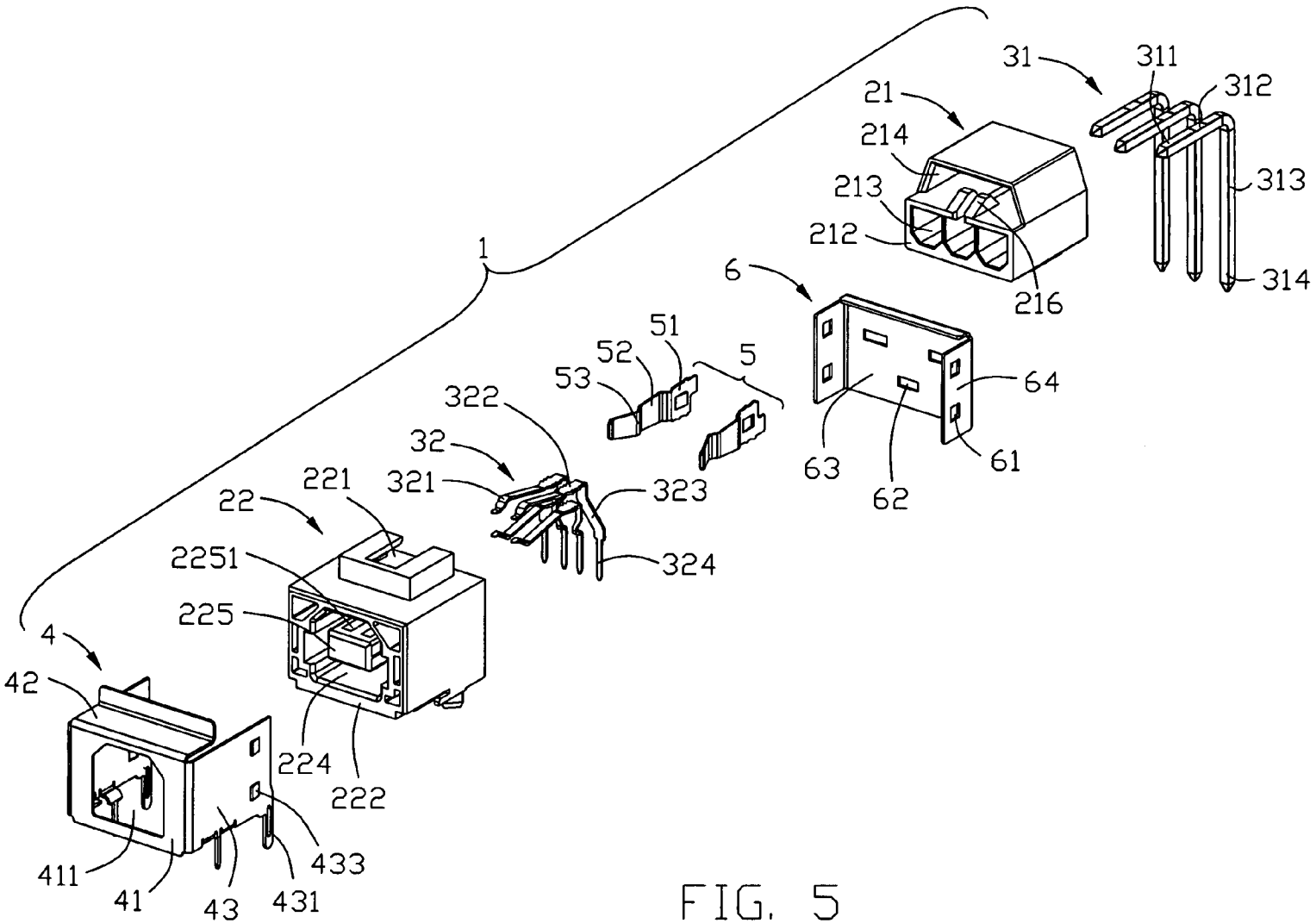
FIG. 5 is an exploded view of the stacked electrical connector shown in FIG. 1.
Figure 6:
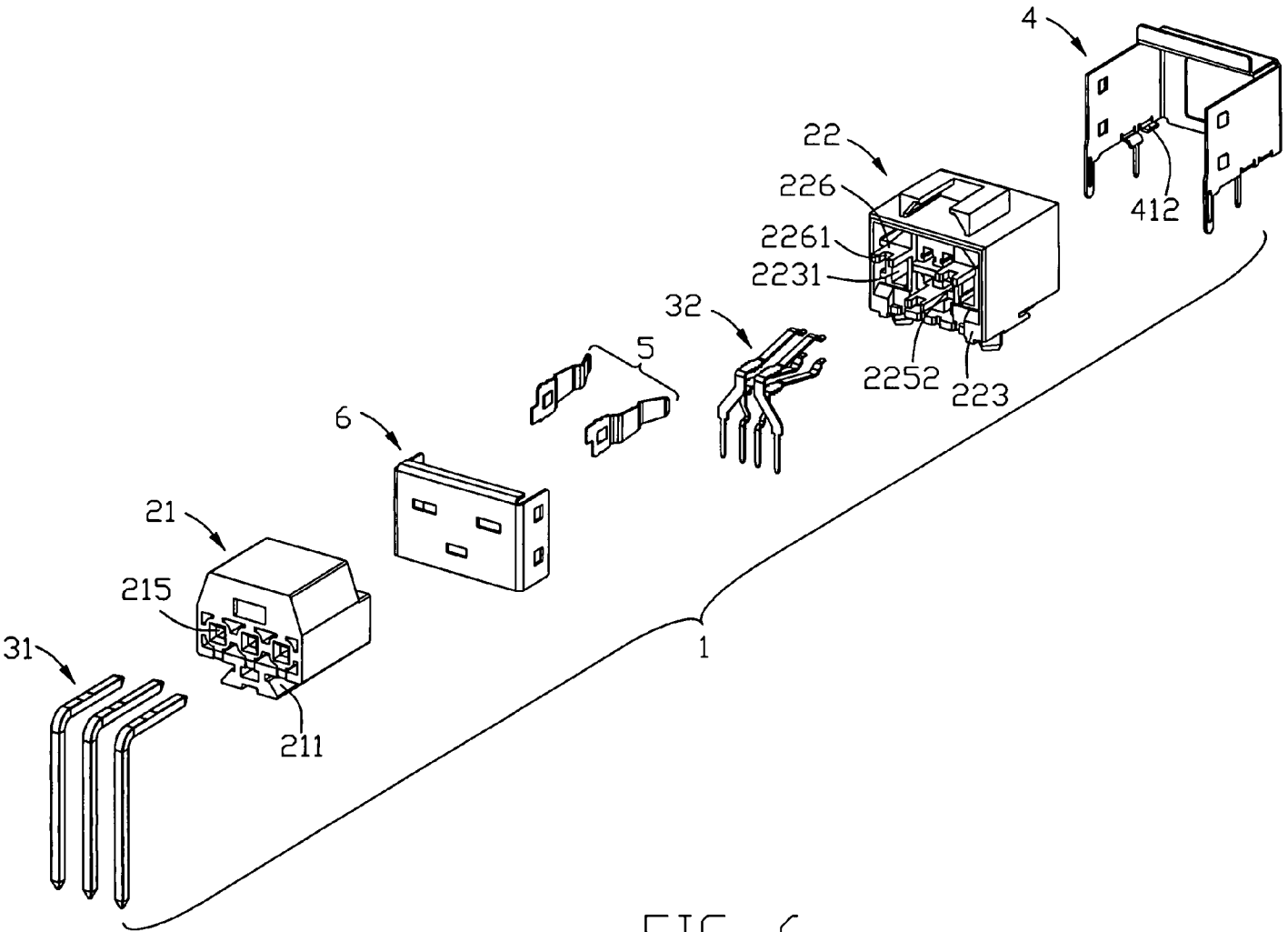
FIG. 6 is a view similar to FIG. 5, while taken from another aspect.

Referring to FIGS. 2, 4 and 5, the first housing 21 comprises a first mating face 212, three inserting ports 213 extending inwardly from the first mating face 212 to receive a power connector (not shown), and a cavity 214 located at an upper portion of the inserting ports 213 to receive the power connector. The first housing 21 defines three passageways 215 extending therethrough and communicating with the inserting ports 213. All the inserting ports 213 are arranged in a row in a level direction and each has a plurality of inner walls. The inner walls comprise opposite first side 2131 and second side 2132, a pair of opposite third sides 2133 respectively connected to two opposite ends of the first side 2131, and a pair of fourth sides 2134 each extending between and interconnecting one of the third sides 2133 and one end of the second side 2132. The first side 2131 is longer than the second side 2132 and substantially parallel to the second side 2132. The third sides 2133 are parallel to each other. The fourth sides 2134 are angled away from each other while extending from the second side 2132 to the third sides 2133. The first sides 2134 of all inserting ports 213 are located in a same plane, and the second sides 2132 of all inserting ports 213 are located in a same plane.

The cavity 214 has opposite first inner wall 2141 and second inner wall 2142, and a pair of opposite side walls 2143 extending between and interconnecting the first inner wall 2141 and the second inner wall 2142. The first inner wall 2142 is shorter than the second inner wall 2142 and parallel to the second inner wall 2142. The side walls 2143 are angled away from each other while extending from the first inner wall 2141 to the second inner wall 2142. The second inner wall 2142 has a pair of protrusions 216 extending into the cavity 214 for locking with the power connector, and a cutout 217 between the protrusions 216. The cutout 217 extends backwardly and communicates with the inserting port 213 and the cavity 214 along the up-to-down direction.

The second housing 22 comprises a front face 222 and a rear face 223 opposite to the front face 22, a receiving space 224 extending inwardly from the front face 22 to receive a standard USB 2.0 B type plug (not shown) therein, and a tongue 225 received in the receiving space 224. The tongue 225 defines two pair of grooves 2251 respectively arranged at an upper side and a lower side thereof. The second housing 22 also defines a pair of retaining slots 2231 recessed from two sides of the rear face 223. The retaining slots 2231 communicate with the receiving space 224. The spring arm 5 has a retaining portion 51 retained in the retaining slot 2231 and an arm portion 52 extending forwardly from the retaining portion 51. The arm portion 52 has a resisting portion 53 extending sideward and into the receiving space 224 for engaging with an USB 2.0 B type plug (not shown).

The second housing 22 defines a plurality of passageways 2252 extending therethrough and communicating with the grooves 2251, and three projections 226 extending backwardly from the rear face 223. Each projection 226 defines a recessed portion 2261 to fasten the contacts 3. Thereby, the contacts 3 can be fixed on the insulative housing 2 stably and not distort easily, and the projections 226 do not need to use much insulative materials. The adjacent two projections 226 are staggered with each other along the up-to-down direction, and the three projections 226 are arranged at vertices of an imaginary triangle. The second housing 22 has a pair of posts 227 at bottom thereof for positioning the electrical connector 1 to a circuit board (not shown).

The contacts 3 comprise three first contacts 31 retained in the first housing 21 and four second contacts 32 retained in the second housing 22. The first contacts 31 are power contacts for transmitting power signals. Each first contact 31 has a first securing portion 312 retained in the passageways 215, a first contact portion 311 extending forwardly into the inserting port 213 from the first securing portion 312, a first soldering portion 314 extending downwardly and out of the insulative housing 2, and a first connecting portion 313 between the first securing portion 312 and the first soldering portion 314. The first connecting portions 313 are retained in the recessed portion 2261 for preventing the first contacts 31 from distorting. The first soldering portions 314 are arranged in a row in the level direction.

The second contacts 32 are similar to that of the standard USB 2.0 B type receptacle, and transmit USB 2.0 signals. The second contacts 32 comprise a power contact, a pair of differential signal contacts and a ground contact. Each second contact 32 has a second securing portion 322 retained in the passageway 2252, a second contact portion 321 extending forwardly from the second securing portion 322, a second soldering portion 324 extending downwardly, and a second connecting portion 323 extending downwardly from the second securing portion 322 to the second soldering portion 324. The second contact portions 321 are arranged in two groups and respectively received in the grooves 2251 of the upper and lower sides of the tongue 225. The second contact portions 321 cantileveredly extend out of the upper and lower sides of the tongue 225. The second connecting portions 323 of the second contacts 32 on the upper side of the tongue 225 extend obliquely and outwardly firstly, and then extend downwardly. The second connecting portions 323 of the second contacts 32 on the lower side of the tongue 225 extend obliquely and inwardly firstly, and then extend backwardly and downwardly. Thereby, the second connecting portions 323 of the second contacts 32 on the upper side of the tongue 225 are located at two sides of the second connecting portions 323 of the second contacts 32 on the lower side respectively, and all the second connecting portions 323 can be arranged in a row in the level direction. The second soldering portions 324 are arranged in a row and located at an inner side of the first soldering portions 314.

The metal shell 4 is mounted on the second housing 22, and comprises a front wall 41 affixing to the front face 222, a top wall 42 extending backwardly from a top end of the front wall 41, and a pair of side walls 43 extending backwardly from two sides of the front wall 41. The front wall 41 defines an opening 411 communicating with the receiving space 224 for receiving the USB 2.0 B type plug. The side walls 43 each has a pair of mounting legs 431 extending downwardly from a lower end thereof, a locking tab 412 extending inwardly from a lower end thereof for engaging with a bottom side of the second housing 22, and a pair of locking tangs 433 extending outwardly. The mounting legs 431 of each side wall 43 are spaced apart from each other along both front-to-back direction and the level direction.

The rear shell 6 is fixed on a rear side of the second housing 22 and located between the first contacts 31 and the second contacts 32 for preventing the first contacts 31 and the second contacts 32 from disturbing with each other. The rear shell 6 has a rear wall 63 and a pair of side wall 64 extending forwardly from two sides of the rear wall 63 respectively. The second contacts 32 are located at an inner side of the rear wall 63, and the first contacts 31 are located at an outer side of the rear wall 63. Each side wall 64 defines a pair of apertures 61 to engage with the locking tangs 433. The rear wall 63 defines three through holes 62 to allow the projections 226 to extend therethrough.

Figure 7:
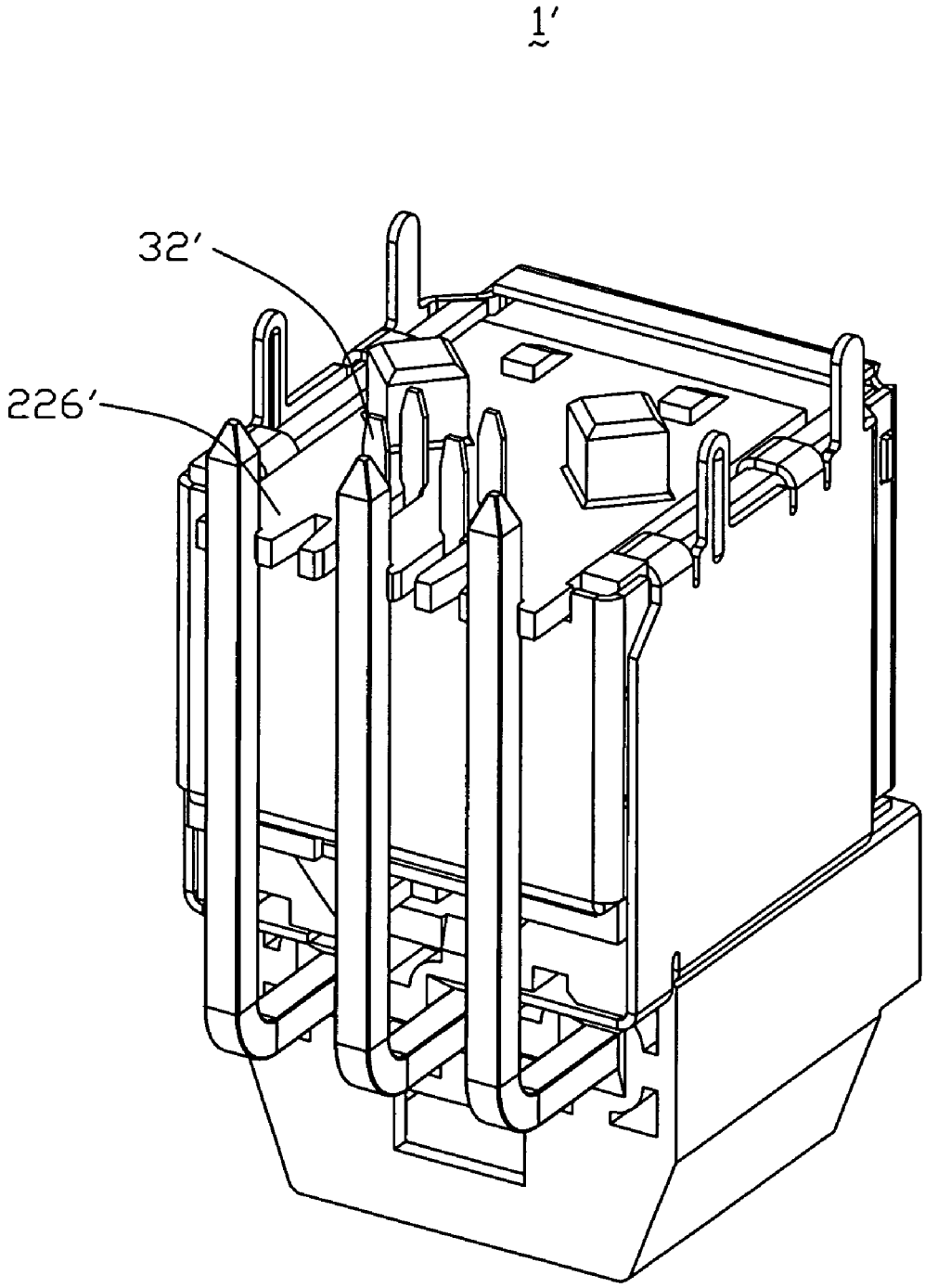
FIG. 7 is a perspective view of a stacked electrical connector according to another embodiment of the present invention.
Figure 8:
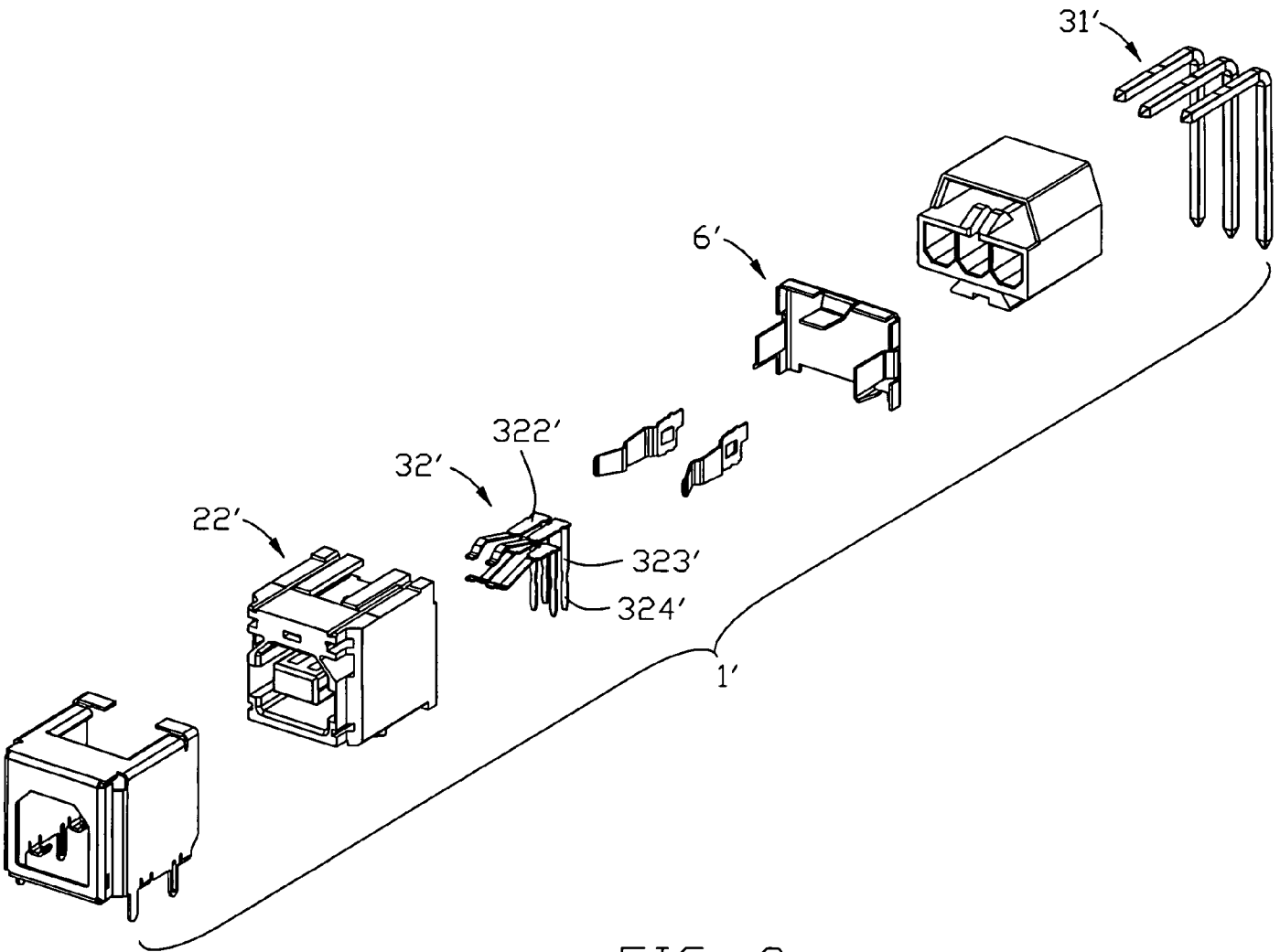
FIG. 8 is an exploded view of the stacked electrical connector shown in FIG. 7.

Referring to FIGS. 7 and 8, a stacked electrical connector 1' according to another embodiment of the present invention is disclosed. Structures of the stacked electrical connectors 1, 1' in two embodiments are similar, and a small difference is that: all the second connecting portions 323' extend vertically and downwardly from the second securing portions 322' directly, and the second connecting portions 323' are arranged in two rows along the front-to-back direction; in addition, the projections 226' for fastening the first contacts 31 extend backwardly from a lower end of the second housing 22' and are arranged in a row in the level direction.

As fully described above, the stacked electrical connectors 1, 1' are stacked by a power jack and an USB 2.0 B type receptacle along the up-to-down direction, thereby the power jack and USB 2.0 B type receptacle in the present invention can only hold a small space of the circuit board for adapting to a miniature development of electronic industry, and decreasing cost of assembly. In addition, the projections 226, 226' extend backwardly from the rear face 223 to retain the first contacts 31, 31', thereby the longest first contacts 31, 31' will not distort easily. Furthermore, the projections 226, 226' only use a little insulative material, and the whole insulative housing 2 need not to extend backwardly, thereby the stacked electrical connectors 1, 1' have a simple structure, and the first contacts 31 can be mounted to the insulative housing 2 conveniently. Finally, the rear shell 6, 6' is arranged between the first contacts 31, 31' and the second contacts 32, 32' for preventing the first contacts 31, 31' and the second contacts 32, 32' from disturbing with each other, and protecting the high signal transmitting speed.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. A stacked connector assembly comprising:

a lower connector unit including a lower insulative housing defining a lower front mating port;

a plurality of lower contacts disposed in the lower insulative housing;

an upper connector unit discrete from the lower connector unit and located upon the lower connector unit and including an upper insulative housing defining an upper front mating port; and a plurality of upper contacts disposed in the upper insulative housing; wherein each of the upper contacts defines a downwardly extending tail section and the lower housing is equipped with a spacer structure to align said tail section;

wherein said lower housing is enclosed in a lower metallic shell including a rear face, and said spacer is located outside of the rear face.

2. The stacked connector assembly as claimed in claim 1, wherein said lower housing is further equipped with another space to align tail sections of the lower contacts, and said another spacer is lower than said spacer.

3. The stacked connector assembly as claimed in claim 1, wherein said spacer extends through and beyond the rear face of the shell.

4. A stacked electrical connector comprising:

an insulative housing comprising a first housing and a second housing arranged along an up-to-down direction, the first housing defining a plurality of inserting ports recessed from a front end thereof, all the inserting ports being arranged in a row in a level direction perpendicular to the upper to down direction, the second housing defining a receiving space to receive a standard USB 2.0 B type plug and a tongue received in the receiving space; and a plurality of contacts comprising a plurality of first contacts retained in the first housing and a plurality of second contacts retained in the second housing, each first contact having a first contact portion extending into the inserting port and a first soldering portion extending downwardly, each second contact having a second securing portion retained in the second housing, a second contact portion extending the tongue from the second securing portion and a second soldering portion extending downwardly from the second securing portion, the second soldering portions of all the second contacts being arranged in a row in the level direction;

wherein the first housing defines a cavity at an upper portion of the inserting ports, the cavity has opposite first inner wall and second inner wall, and a pair of side walls extending between and interconnecting the first inner wall and the second inner wall, the first inner wall being shorter than the second inner wall and parallel to the second inner wall, the side walls angled away from each other while extending from the first inner wall to the second inner wall.

5. The stacked electrical connector according to claim 4, wherein each inserting port has a plurality of inner walls, and the inner walls comprise opposite first and second sides, a pair of opposite third sides respectively connected to two opposite ends of the first side, and a pair of fourth sides each extending between and interconnecting one of the third sides and one end of the second side, the first side being longer than the second side and substantially parallel to the second side, the third sides being parallel to each other, the fourth sides being angled away from each other while extending from the second side to the third sides, the first sides of all inserting ports being located in a same plane, and the second sides of all inserting ports being located in a same plane.

6. The stacked electrical connector according to claim 4, wherein the second inner wall has a pair of protrusions extending into the cavity and a cutout between the protrusions, the cutout extends backwardly and communicates with the inserting port and the cavity along the up-to-down direction.

7. The stacked electrical connector according to claim 4, wherein the first housing defines a plurality of first passageways communicating with the inserting ports, and the first contact has a first securing portion retained in the passageways, the first soldering portion extend downwardly from the first securing portion, and the first soldering portions are arranged in a row in the level direction.

8. The stacked electrical connector according to claim 4, wherein the second contacts comprise a power contact, a pair of differential signal contacts and a ground contacts which are similar to that of the standard USB 2.0 B type receptacle, the four second contacts are arranged in two groups and respectively located at the upper and lower sides of the tongue respectively.

9. The stacked electrical connector according to claim 8, wherein each second contact has a second connecting portion between the second securing portion and the second soldering portion, wherein the second connecting portions of the second contacts on the lower side extend obliquely and inwardly firstly, and then extend backwardly and downwardly, while the second connecting portions of the second contacts on the upper side extend obliquely and outwardly firstly, and then extend downwardly to locate at two sides of the second connecting portions of the second contacts on the lower side.

10. The stacked electrical connector according to claim 4, further comprising a metal shell and a rear shell covering the second housing and a pair of spring arms extending into the receiving space, the rear shell is located between the first contacts and the second contacts to separate the first and second contacts from each other, and engage with the metal shell.

11. The stacked electrical connector according to claim 10, wherein the second housing has a front face, a rear face opposite to the front face, and a plurality of projections extending backwardly from the rear face to retain the first contacts, the rear shell defining a plurality of through holes to allow the projections to extend therethrough.

12. A stacked electrical connector comprising:

an insulative housing comprising a first housing and a second housing arranged in an up-to-down direction, the first housing defining a plurality of inserting ports recessed from a front end thereof, the second housing having a front face and a rear face opposite to the front face; and a plurality of contacts comprising a plurality of first contacts retained in the first housing, each first contact has a first securing portion retained in the first housing, a first contact portion extending into the inserting port from the first securing portion, a first soldering portion extending out of the insulative housing and a first connecting portion between the first securing portion and the first soldering portion;

wherein the second housing has a plurality of projections extending backwardly from the rear face, each projection defines a recessed portion to retain the first connecting portion;

wherein each inserting port has a plurality of inner walls, and the inner walls have opposite first and second sides, a pair of opposite third sides respectively connected to two opposite ends of the first side, and a pair of fourth sides each extending between and interconnecting one of the third sides and one end of the second side, the first side being longer than the second side and substantially parallel to the second side, the third sides being parallel to each other, the fourth sides being angled away from each other while extending from the second side to the third sides, the first sides of all inserting ports being located in a same plane, and the second sides of all inserting ports being located in a same plane.

13. The stacked electrical connector according to claim 12, wherein the adjacent two projections are staggered with each other along the up-to-down direction.

14. The stacked electrical connector according to claim 13, wherein the second housing has three said projections, and the three projections are arranged at vertices of an imaginary triangle.

15. The stacked electrical connector according to claim 12, wherein the projections extend from a lower end of the rear face and are arranged in a row in a level direction.

16. The stacked electrical connector according to claim 12, wherein the second housing defines a receiving space and a tongue received in the receiving space, the contacts comprise a plurality of second contacts retained in the second housing, each second contact has a second securing portion retained in the second housing, a second contact portion extending to the tongue from the second securing portion, a second soldering portion and a second connecting portion between the second securing portion and the second soldering portion.

17. The stacked electrical connector according to claim 16, further comprising a rear shell covering the rear face, the rear shell is located between the first connecting portions and the second connecting portions.

* * * * *